United States Patent [19]

Garland

[11] 3,993,011

[45] Nov. 23, 1976

[54] METHOD AND APPARATUS FOR RETRIEVING, SECURING, AND LAUNCHING AN ANCHOR BUOY

[75] Inventor: Eddie Clark Garland, Stavanger, Norway

[73] Assignee: Brown & Root, Inc., Houston, Tex.

[22] Filed: Jan. 8, 1976

[21] Appl. No.: 647,579

[52] U.S. Cl. ..... 114/43.5 VC; 114/210; 214/15 R

[51] Int. Cl.[2] ..... B63B 27/00

[58] Field of Search ..... 9/8 R, 34, 38; 114/43.5 R, 43.5 VC, 210, 206 R, 44, 48; 214/12, 15 R

[56] References Cited

UNITED STATES PATENTS

| | | | |
|---|---|---|---|
| 2,761,571 | 9/1956 | Adams | 214/15 R |
| 2,997,188 | 8/1961 | Hauser | 214/15 R |
| 3,303,945 | 2/1967 | Hubbard et al. | 214/15 R |
| 3,536,023 | 10/1970 | Toher et al. | 114/43.5 VC |
| 3,906,879 | 9/1975 | Lucht | 114/43.5 R |

FOREIGN PATENTS OR APPLICATIONS

| | | | |
|---|---|---|---|
| 630,145 | 3/1963 | Belgium | 9/34 |

*Primary Examiner*—Trygve M. Blix
*Assistant Examiner*—Charles E. Frankfort

[57] ABSTRACT

Method and apparatus for retrieving, securing, and launching an anchor buoy characterized by an anchor buoy handling mechanism mounted on the stern of a service vessel and including apparatus for engaging a floating anchor buoy, elevating the anchor buoy, and moving the anchor buoy to a substantially immobilized position on a stern deck portion of the service vessel.

10 Claims, 20 Drawing Figures

Figures 1, 15:
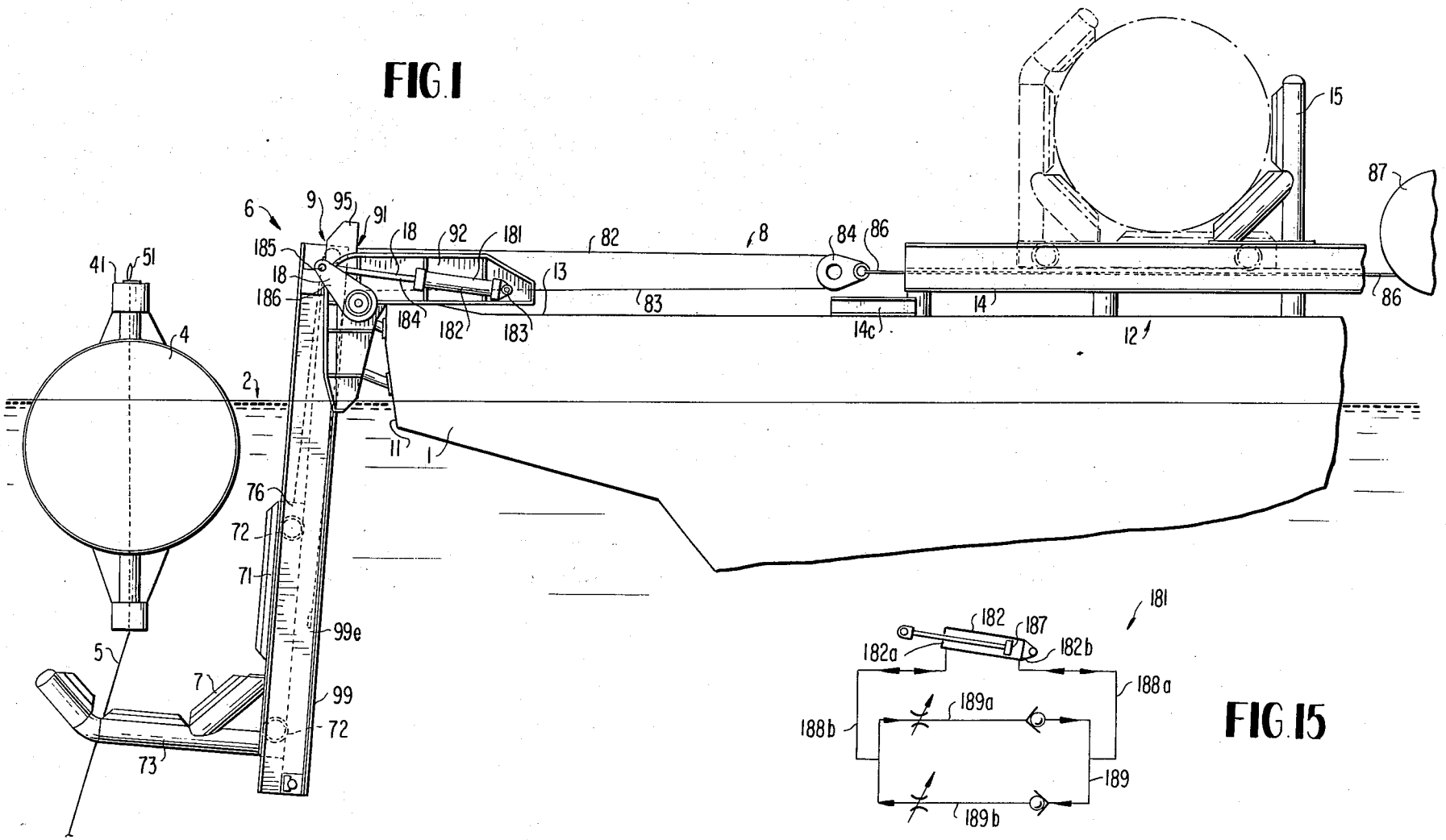

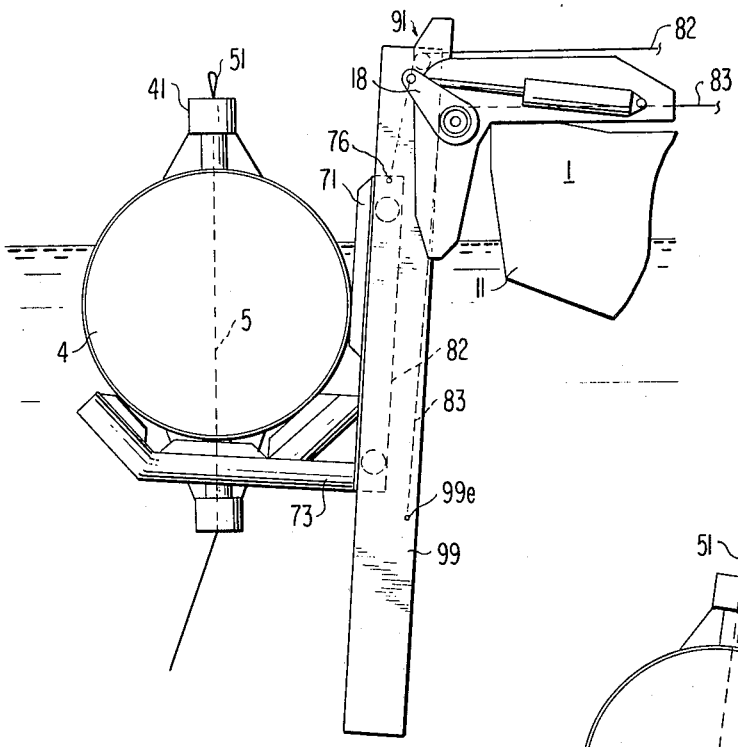
FIG. 7a
FIG. 7b
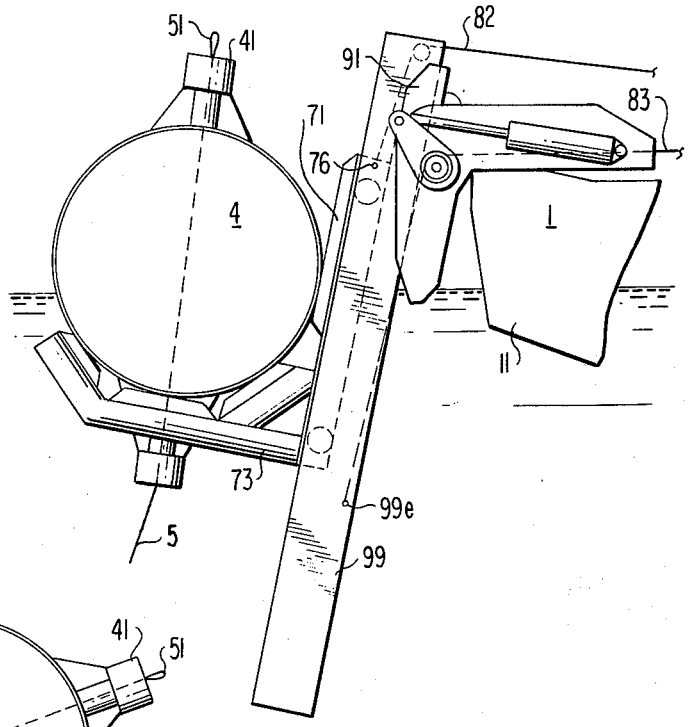
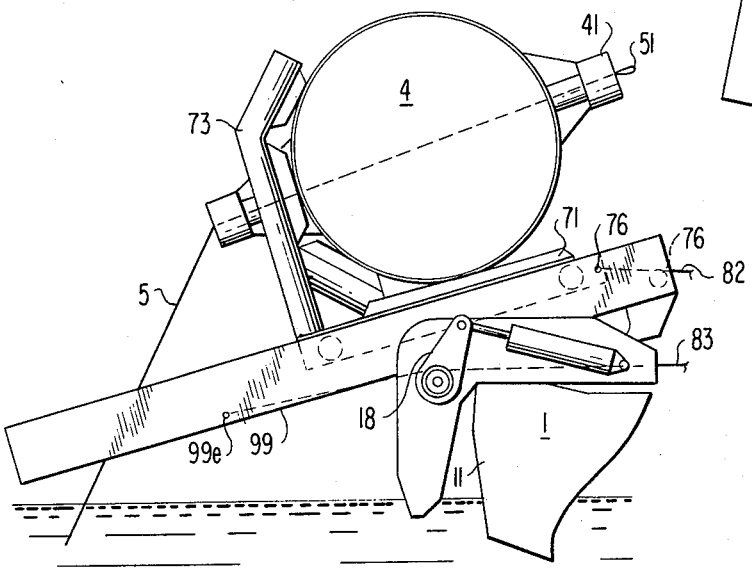
FIG. 7c

METHOD AND APPARATUS FOR RETRIEVING, SECURING, AND LAUNCHING AN ANCHOR BUOY

GENERAL BACKGROUND AND SUMMARY OF INVENTION

Off-shore pipelining and construction operations are often conducted with barges which are propelled or manipulated by anchor line propulsions systems.

In general, such anchor line propulsion systems are characterized by two alternately operable "spreads" of groups of anchors. Each such spread may include four anchors, each having an anchor line extending diagonally from an anchor line winch station located at one of the four barge corners.

Generally, one such spread of anchors is employed at a time to effect barge manipulation, i.e. by "pulling-in" on the forward anchors and "paying-out" on the stern anchor lines. While the anchor lines of one such spread are being manipulated to effect barge movement, the alternately operable spread of anchors is being repositioned to take over the propulsion operation in a "leap-frog" manner when the anchor lines of the first spread have been moved to the extremities of their operable positions.

The present invention deals with the problems entailed in the difficult off-shore operating environment in manipulating anchors to new positions so as to effect the leap-frog propulsion technique above described.

Heretofore, it has been the general practice for service vessels such as off-shore tugs to relocate anchors by engaging looped ends of pendant lines, each of which is supported at the water surface by an anchor buoy and extends down through the water body to an anchor. Generally, pendant lines are slideably supported by such anchor buoys so that, when a pendant line is engaged by a service vessel, the pendant line may be attached to a winch and drawn in. The drawing in of the pendant line exerts a disengaging force on the pendant line associated anchor and enables the anchor to be supported by the service vessel for relocation purposes.

Substantial difficulties have been involved in pendant line engaging and retrieving operations of the type heretofore noted.

It has been a general practice for crewmen to lean out over outboard portions of a service vessel and manually manipulate a hook, conventionally termed a "tail chain hook" into hooked engagement with the looped end of a pendant line supported by the floating anchor buoy. This engaging operation may be awkward, particularly when rough seas are encountered.

The potentially hazardous nature of this operation requires substantial precautionary measures in order to adequately protect the safety and well-being of crewmen engaged in the pendant line engaging and retrieving operation. Such precautionary measures may inherently slow and complicate anchor line relocating operations.

Moreover, the anchor buoy, which generally remains located adjacent the stern of the service vessel, during the pendant line retrieving operation, may cause damage to the hull of the service boat or may be damaged itself as a result of rough sea conditions.

This invention constitues a marked departure from the prior art practices noted above and is characterized by a technique for mechanically "forking" or retrieving pendant line supporting anchor buoy from a body of water, rapidly elevating the anchor buoy above deleterious wave action, and depositing the anchor buoy in a safe, substantially stabilized and immobilized position on a stern deck portion of the service vessel. At this location, crewmen may safely and more easily manipulate a pendant line loop into engagement with a hoisting drum so as to effect the hoisting or retrieving of the pendant line and thereby the hoisting of the anchor for relocation purposes.

These objectives are accomplished by a system for retrieving, securing, and launching an anchor buoy, this apparatus being operable in combination with

- floating vessel means floating on a body of water,
- anchor pendant line hoisting means carried by the floating vessel means, and
- floating anchor buoy means, including pendant line means, usually slideably supported by the anchor buoy means, having an engageable loop or eye in its upper end, and extending downwardly to engagement with a submerged anchor.

The apparatus is characterized by, and comprises, a mechanism including

- anchor buoy catching means,
- anchor buoy elevating means, and
- anchor buoy securing means.

The anchor buoy catching means is operable to engage the anchor buoy means while the anchor buoy means is floating on the body of water.

The anchor buoy elevating means is operable to elevate the anchor buoy catching means, with the anchor buoy means engaged therewith.

The anchor buoy securing means is operable to move the anchor buoy catching means, with the anchor buoy means engaged therewith, toward a substantially immobilized position above the body of water.

The pendant line means is operable, with the anchor buoy catching means and anchor buoy means disposed in the substantially immobilized position, to be engaged with the pendant line hoisting means carried by the floating vessel means. The pendant line hoisting means, so engaged with the pendant line means, is operable to effect hoisting of the pendant line means.

The pendant line hoisting means is thus operable to effect the hoisting of the pendant line means and is further operable to permit the subsequent paying out of the pendant line means subsequent to this hoisting operation.

The pendent line means is operable to exert a pulling force on the anchor buoy means. This pulling force is operable to cause

- the anchor buoy means to move away from the substantially immobilized position generally toward the water body, and
- the anchor buoy means to be deposited in the body of water and freed from the floating vessel means.

In more specific and independently significant aspects, the invention involves apparatus concepts dealing with a composite slideable and pivotable mounting arrangement for the anchor buoy catching means an anchor buoy securing means, with the anchor buoy elevating means comprising a cable and sheave arrangement which is operable to effect a relatively rapid initial elevating movement of the anchor buoy catching means.

Other independently significant apparatus aspects of the invention deal with a service boat, deck mounted track arrangement which provides an immobilizing arrangement for the anchor buoy catching means and an anchor buoy clamping means which operates to clamp fore and aft portions of the anchor buoy means.

The invention further contemplates, as a independently significant concept, a releasable locking arrangement for releasably interlocking the anchor buoy catching and securing means. This locking arrangement may be advantageously combined with an automatically operable release mechanism. This latter mechanism releases the anchor buoy catching means from the anchor buoy securing means for movement at least partially into the aforesaid track means, this releasing action preferably being effected automatically in response to engagement of the anchor buoy securing means with a stern deck portion of the floating vessel means.

Still further independently significant apparatus aspects of the invention may entail wave action ameliorating, shock absorbing means for controlling and minimizing wave action induced forces, acting on the anchor buoy and anchor buoy catching means. With this shock absorbing mechanism there may be employed electromagnetic anchor buoy holding means carried by the anchor buoy catching means.

In describing the invention in greater detail, reference will be made, by way of example—but not by way of limitation—to a presently preferred embodiment illustrated in the appended drawings.

DRAWINGS

The appended drawings, in varying views, depict structural and operational aspects of a presently preferred embodiment of the invention.

Figure 2:
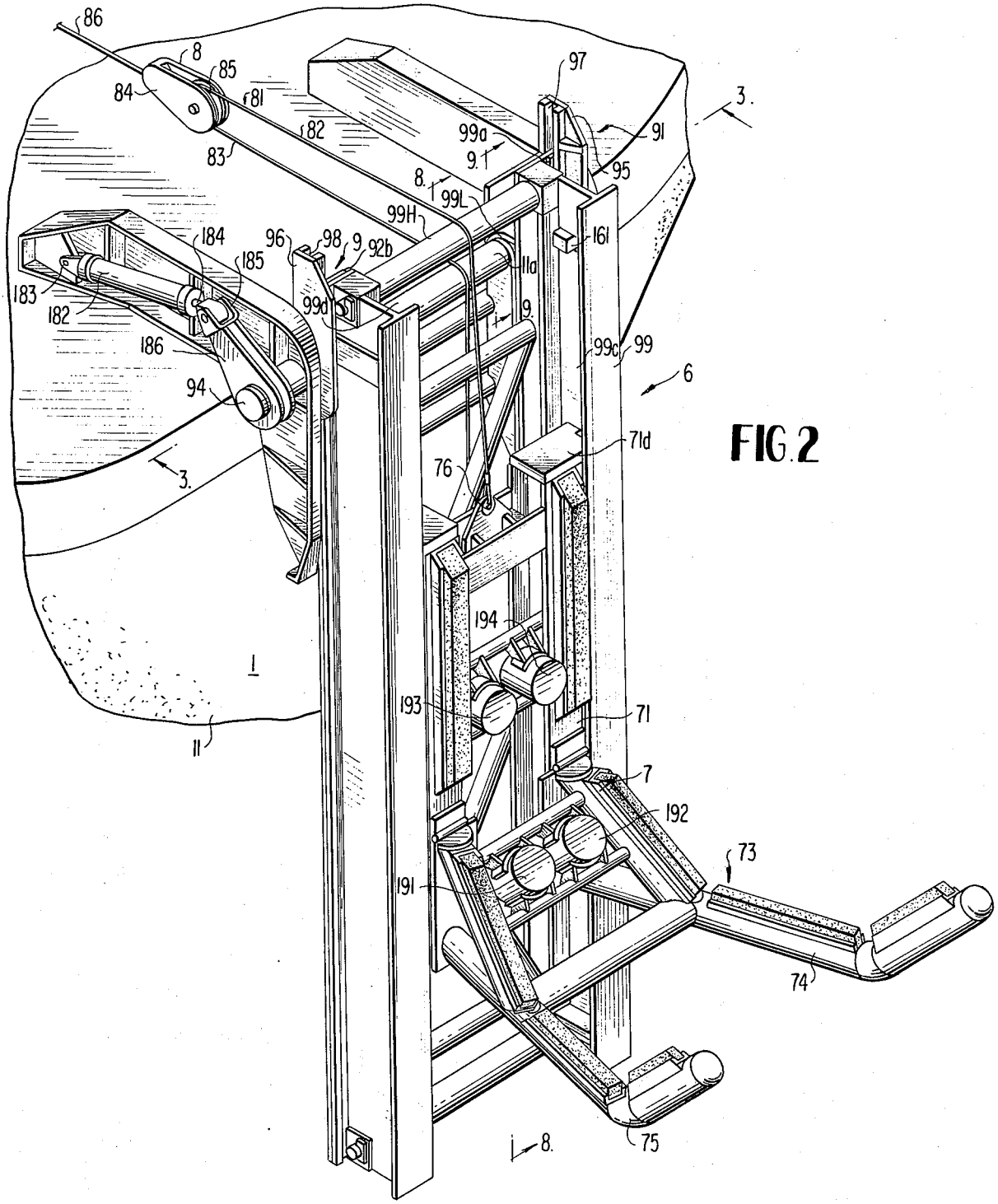
Figure 3:
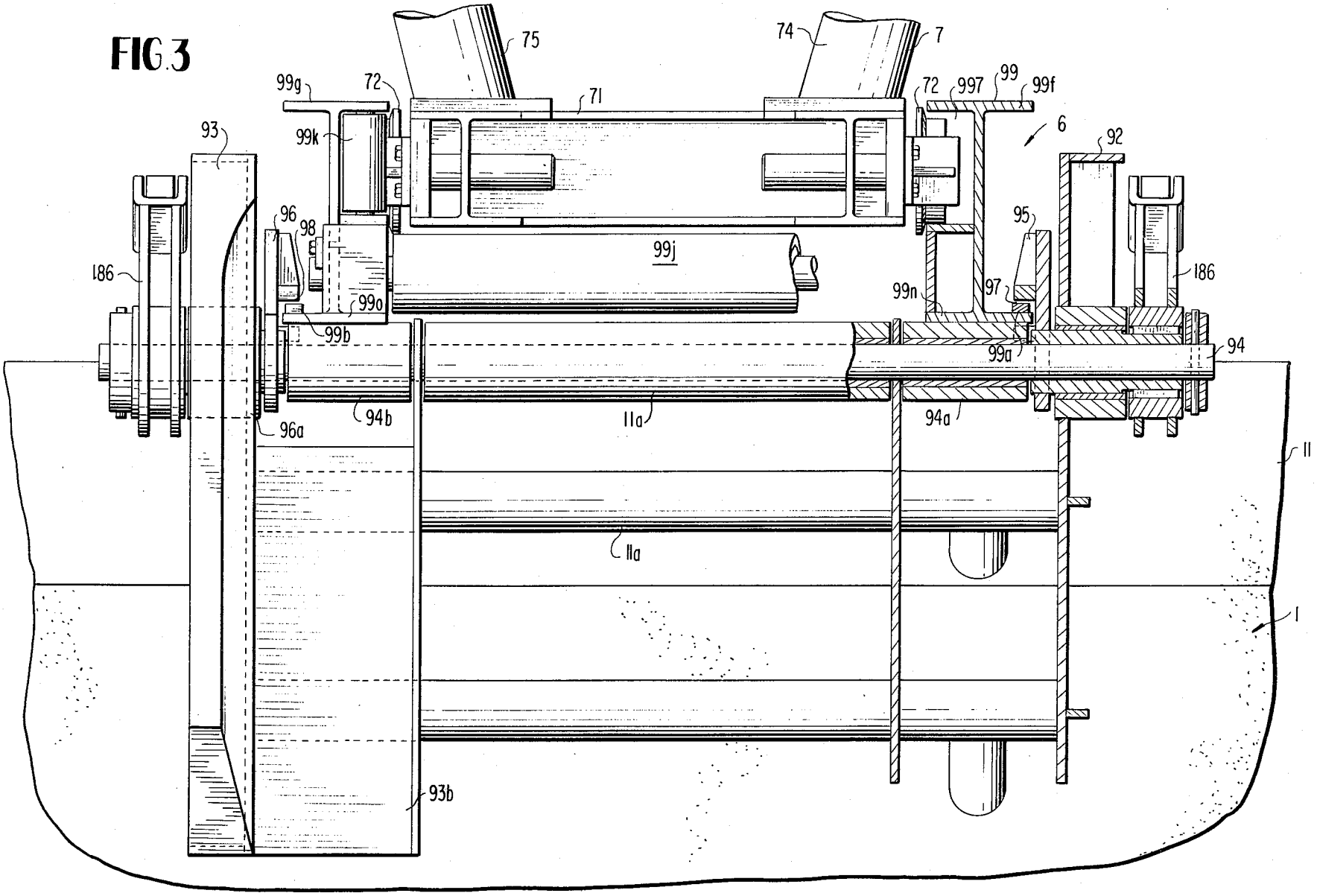
Figure 4:
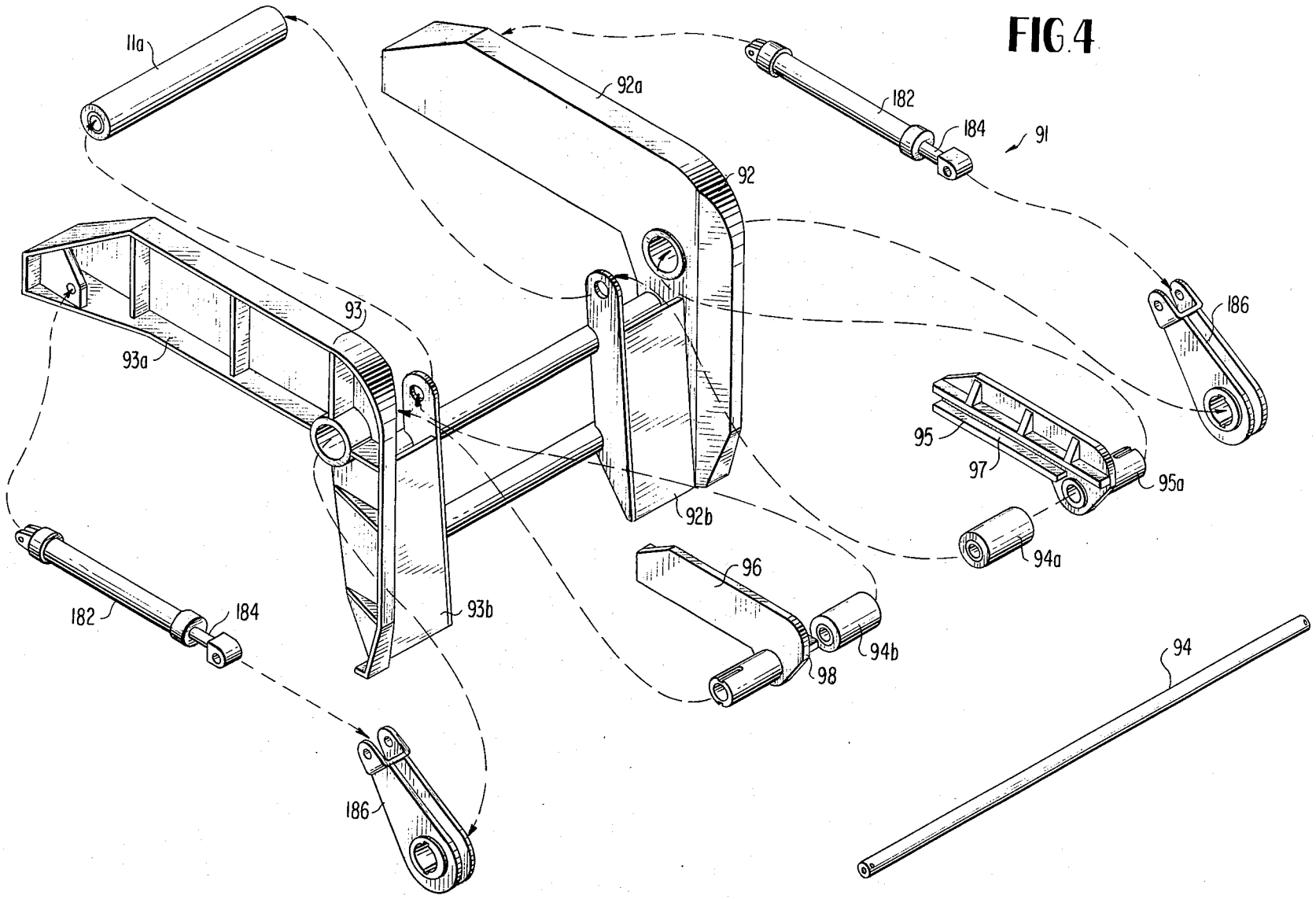
Figure 5:
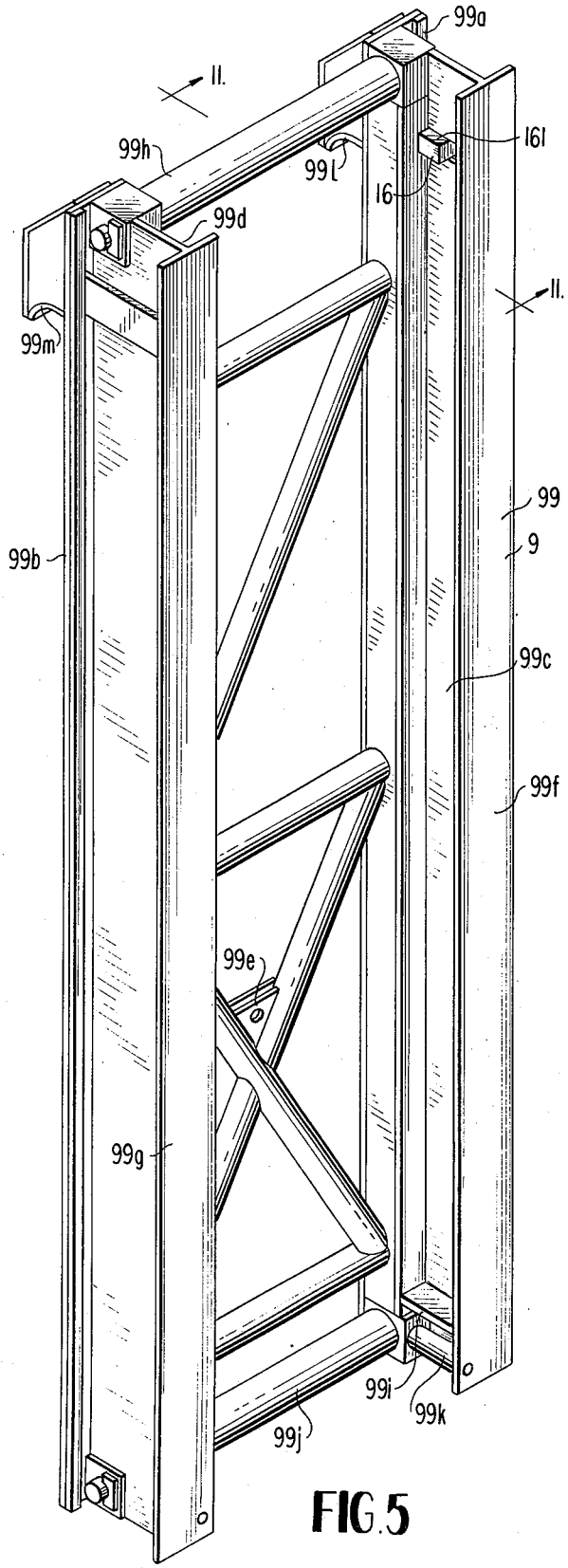
Figure 6:
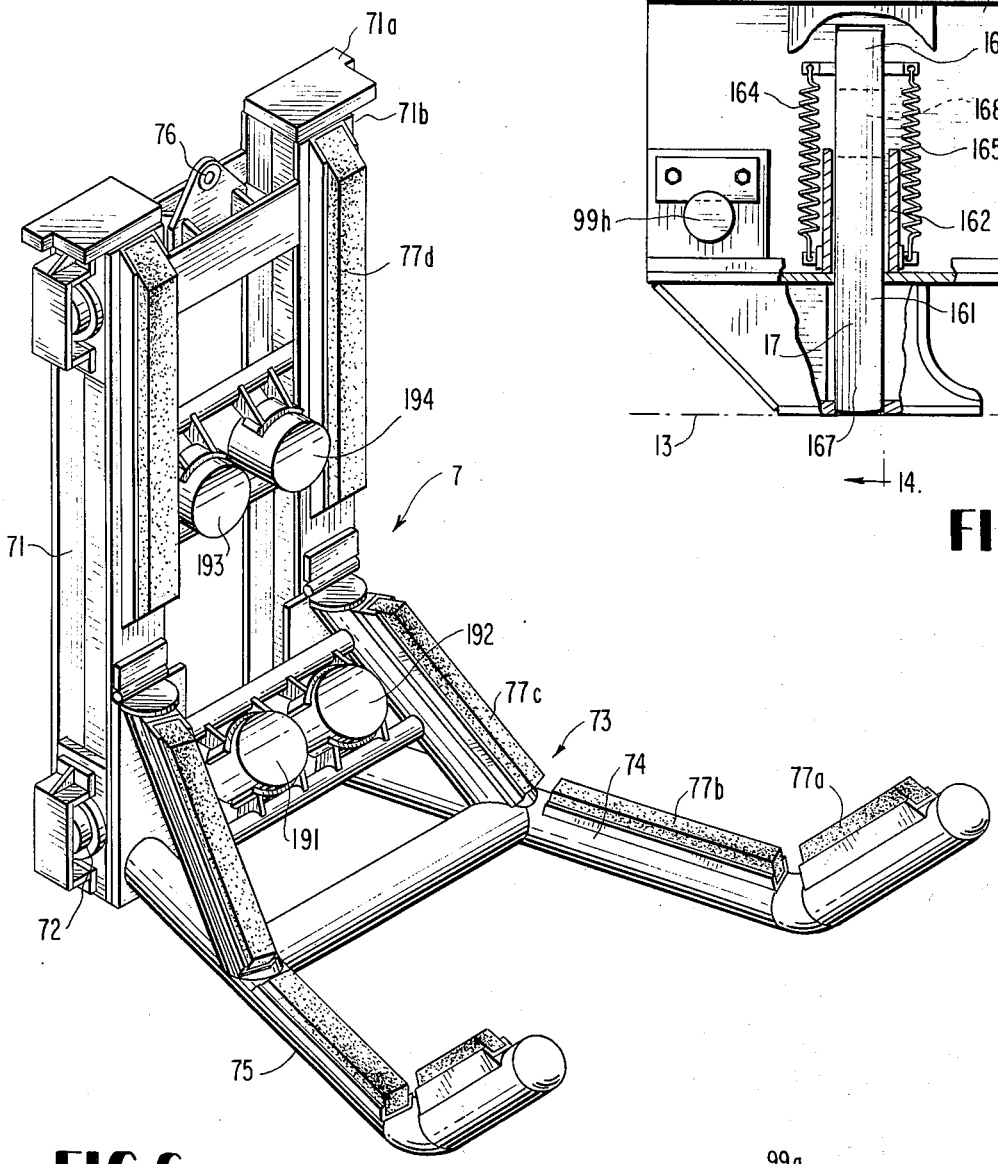

As shown in the drawings:

FIG. 1 provides a fragmentary, side elevational view of a stern portion of a service vessel such as a tug boat, illustrating in solid line an anchor buoy disposed in position adjacent to stern of the service vessel and about to be engaged by an anchor buoy catching, elevating, and securing mechanism (with the mechanism and anchor buoy being shown in phantom line in its caught, elevated, and secured position on a stern deck portion of the service vessel);

FIG. 2 provides an enlarged, fragmentary, and perspective view of the stern portion of the FIG. 1 vessel, illustrating structural details of the anchor buoy catching, elevating, and securing mechanisms, FIG. 2 comprising a perspective view from the port-stern quarter of the vessel;

FIG. 3 provides a fragmentary, transverse sectional view of the FIG. 2 mechanism, viewed along view direction 3—3 of FIG. 2, with the catching and securing means moved up onto the vessel deck;

FIG. 4 provides an "exploded", perspective view of pivotal movement facilitating components of the anchor buoy securing means of the FIG. 3 assembly;

FIG. 5 provides an enlarged, perspective view of a slideable frame component of the anchor buoy securing means of the FIG. 3 assembly;

FIG. 6 provides an enlarged, perspective view of the anchor buoy catching means of the FIG. 3 assembly which is operable to be slideably mounted in the FIG. 5 frame in the manner generally depicted in FIG. 3;

FIGS. *7a* through *7f* depict side elevational views (viewed from the starboard side as in FIG. 1) of the FIG. 1–3 catching, elevating, and securing mechanism and illustrating various stages in operational sequence of this system;

FIG. *7a* depicts the FIG. 1–3 system with an anchor buoy caught or cradled by the anchor catching means;

FIG. *7b* depicts the system with the anchor buoy elevating means having effected partial elevation of the caught anchor buoy and the anchor buoy catching means, with the anchor buoy catching means having commenced pivotal movement about the stern of the service vessel;

FIG. *7c* illustrates the FIG. 1–3 system with the anchor buoy securing means having undergone upward sliding and forward pivoting movement about a pivot axis at the stern of the service vessel, and with the anchor buoy catching means having previously undergone relatively rapid upward elevating movement on the anchor buoy securing means frame;

FIG. *7d* illustrates the FIG. 1–3 system with the frame of the anchor buoy securing means having come to rest in a substantially horizontal position on a stern deck portion of the floating vessel, forward of the securing means pivot axis, and with the anchor buoy catching means still being slideably mounted on the securing means frame;

FIG. *7e* illustrates the FIG. 1–3 system wherein, subsequent to the FIG. *7d* positioning of its components, the anchor buoy catching means has been freed from interlocking engagement with the frame of the anchor buoy securing means and has commenced forward longitudinal sliding movement out of the securing means frame into a track system mounted on the stern deck of the service vessel; and FIG. *7f* illustrates components of the FIG. 1–3 system where the fork-like anchor buoy catching means, with the anchor buoy engaged therewith, has moved fully free of the frame of the anchor buoy securing means into slideable, and immobilizing, cooperation with the deck mounted stabilizing track, and with the fork-like catching means having carried the anchor buoy forward into abutting cooperation with a generally upright anchor buoy clamping means. As here shown, the clamping means and fork portions of the catching means, respectively, engage and secure fore and aft portions of the deck mounted anchor buoy, thereby permitting the anchor buoy carried pendant line to be slid through the anchor buoy and engaged with a hoisting mechanism for pendant line hoisting operations.

Figure 9:
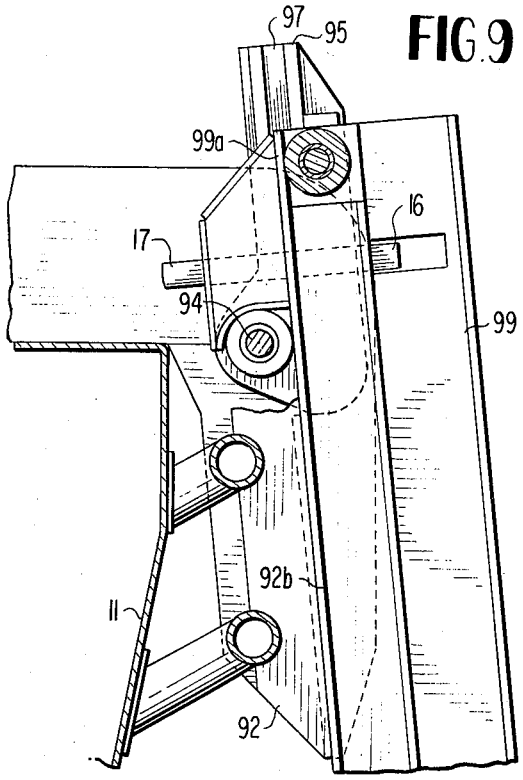
Figure 10:
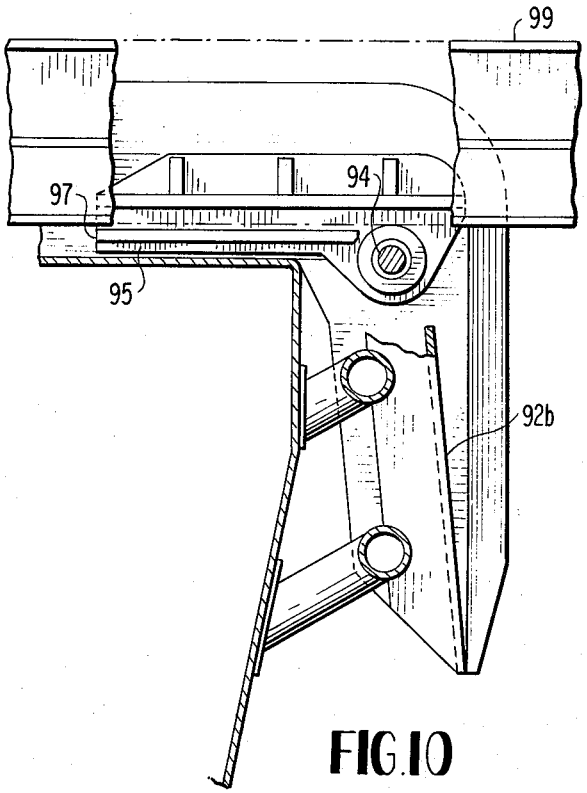
Figure 13:
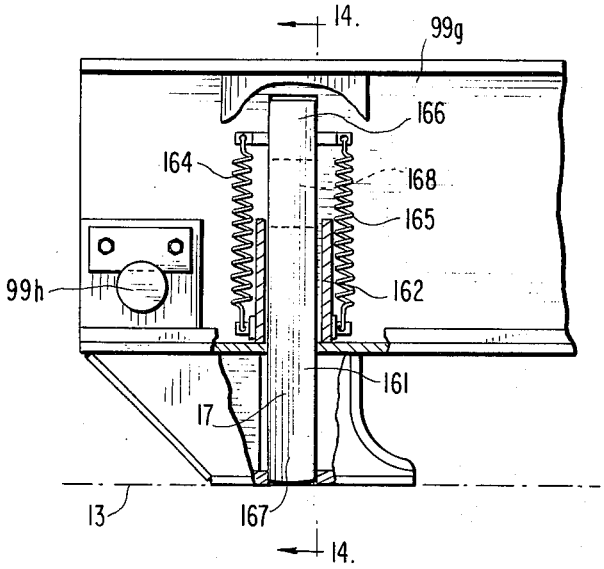
Figure 14:
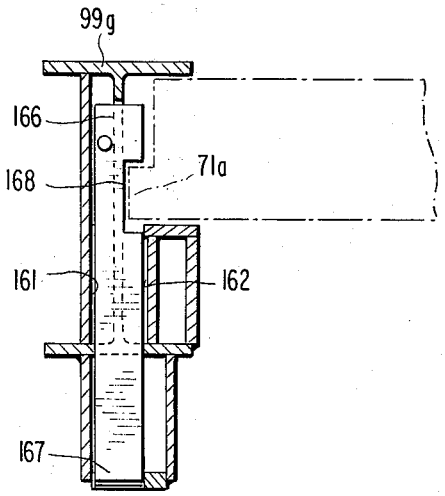
Figure 11:
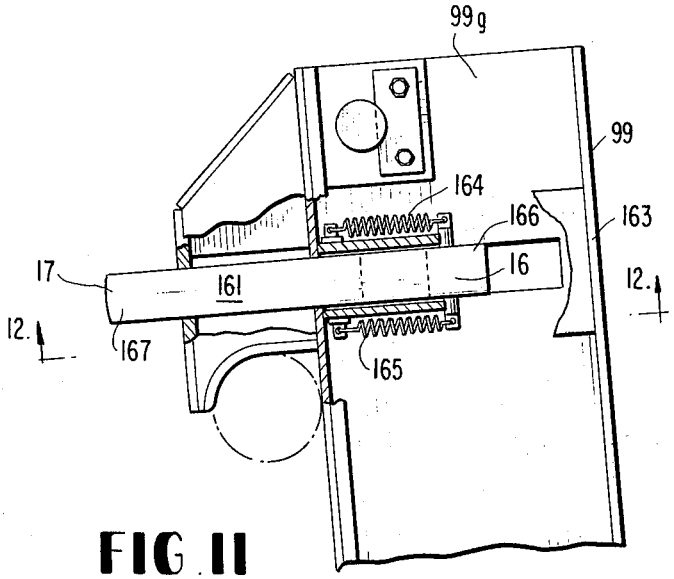
Figure 12:
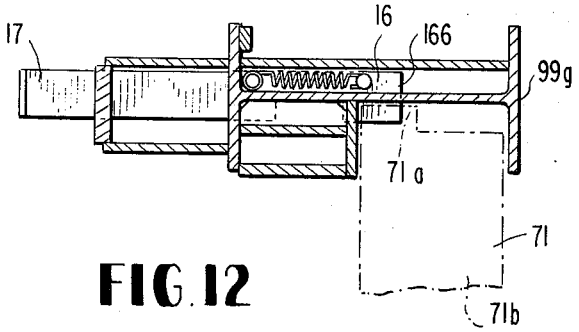
Figure 8:
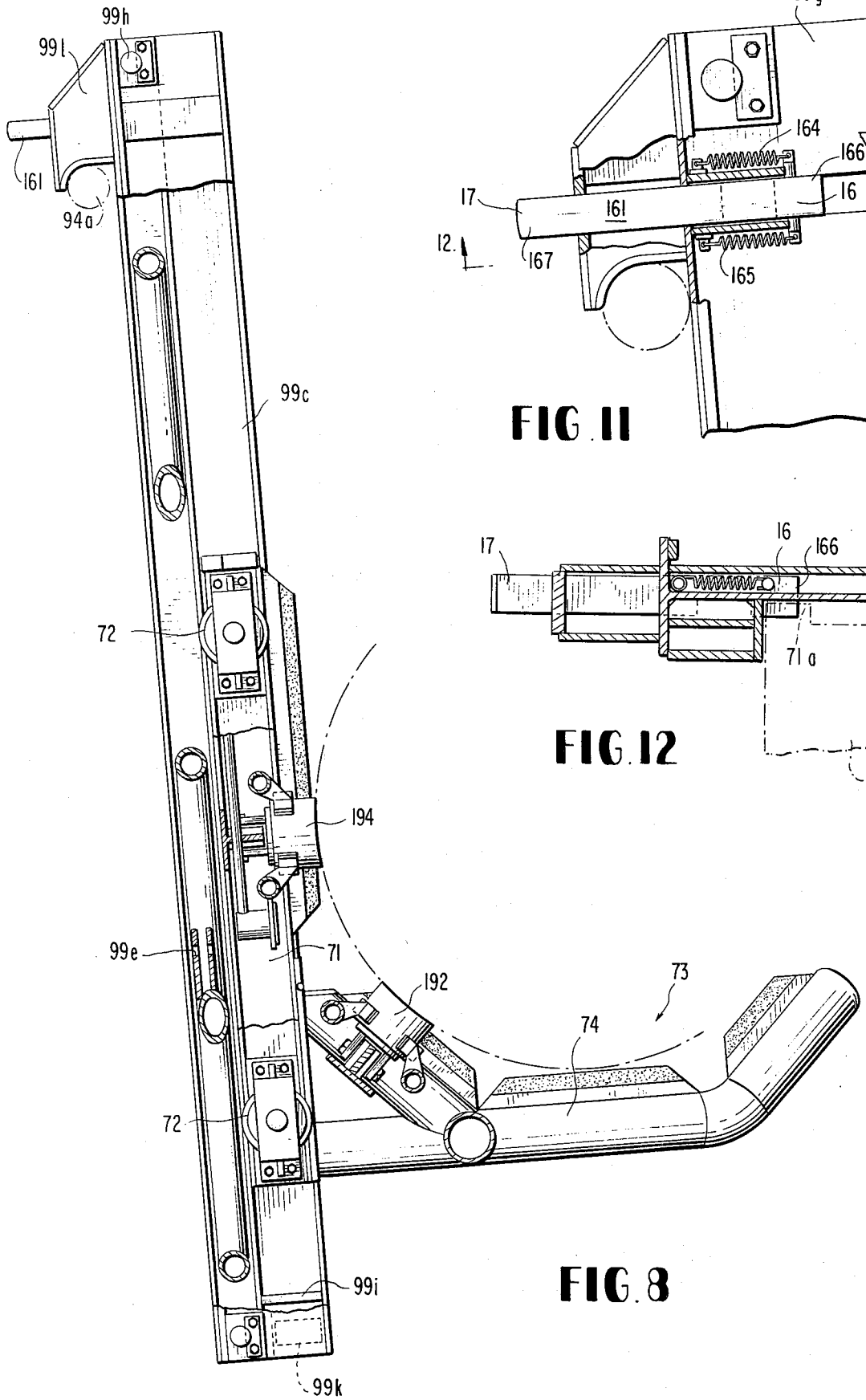

FIG. 8 provides an enlarged, elevational, fragmentary, sectional view of the FIG. 1–3 anchor buoy catching, elevating, and securing mechanism, as viewed generally along view direction 8—8 of FIG. 2, with a mechanism supporting, stern roller of the service vessel being shown in phantom line for purposes of view correlation;

FIG. 9 provides an enlarged, fragmentary, elevational and sectional view of a pivot mounting portion of the FIG. 1–3 mechanism, as viewed generally along view direction 9—9 of FIG. 2;

FIG. 10 provides a modified showing of the pivot mechanism depicted in FIG. 9 wherein a pivot mounting has undergone counterclockwise pivotal movement, as depicted in FIG. 9, so as to bring an anchor buoy securing means frame from the generally upright orientation depicted in FIGS. 2 and 9 to the condition depicted in FIG. *7d*, and wherein the anchor buoy securing means frame has slid partially longitudinally through the pivot mount mechanism, whereby, as a result of this composite pivotal and sliding movement, the frame has been positioned so as to extend generally longitudinally of the service vessel stern deck;

FIG. 11 provides an enlarged, fragmentary, elevational and sectional view of a releasable locking mechanism incorporated in the FIG. 1–3 system for the purpose of releasably interlocking the boyd of the anchor buoy catching means depicted in FIG. 6 with the frame of the anchor buoy securing means depicted in FIG. 5, the releasable locking mechanism of FIG. 11 being viewed along the view direction 11—11 of FIG. 5;

FIG. 12 provides a transverse sectional view of the FIG. 11 releasable locking mechanism as viewed along section line 12—12 of FIG. 11, the releasable locking mechanism as depicted in each of FIGS. 11 and 12 being shown in a locking mode, with FIG. 12 further illustrating, in phantom line, the body of anchor buoy catching means being restrained by this locking mechanism;

FIG. 13 depicts the FIG. 11 locking mechanism when the frame of the anchor buoy securing means depicted in FIG. 5 has come to rest on the stern deck of a service vessel as generally depicted in FIG. *7d* so as to release the locking influence of the locking mechanism with respect to the body of the anchor buoy catching means;

FIG. 14 provides a transverse sectional view of the FIG. 13 showing of the releasable locking mechanism, as viewed generally along section line 14—14 of FIG. 13, with each of FIGS. 13 and 14 depicting the locking mechanism in a released mode so as to permit sliding separation of the anchor buoy catching means from the anchor buoy securing means in the manner generally depicted, in sequence, in FIGS. *7d* and *7e;* and FIG. 15 provides a schematic showing of a hydraulic circuit which may be incorporated with the pivot mechanism of the FIG. 1–3 assembly for the purpose of controlling and minimizing the influence of wave action acting on the anchor buoy catching means and an anchor buoy means secured thereby, and generally controlled the relative sequence of sliding and pivoted movements of components of the mechanism.

Having described basic structural and operational aspects of the presently preferred embodiment of the invention in the context of the appended illustrations, it is now appropriate to give further consideration to detailed aspects of the invention.

GENERAL DESCRIPTION

FIGS. 1–6 and 8–15 depict structural details of a presently preferred form of the anchor buoy catching, elevating, and securing mechanism of the present invention. FIGS. *7a* through *7f* depict, in a sequential format, the manipulative steps performed by the mechanism during an anchor buoy retrieving operation. In general, the reverse of this sequence occurs when the anchor buoy is to be launched from the service vessel.

In describing the mechanism, reference will be made, in order, to a. the overall context of the invention,
b. the major components of the anchor buoy catching, elevating and securing mechanism,
c. details of anchor buoy catching, elevating, and securing components,
d. details of a mechansim securing, track and clamp combination,
e. details of a releasable interlock which releasably interconnects the anchor buoy catching and securing components,
f. details of a wave action and pivot restraining system and electromagnetic, anchor buoy holding means, and g. miscellaneous structural details.

a. Overall Context of Invention

An apparatus for retrieving, securing, and launching an anchor buoy, as depicted in this invention and shown in FIGS. 1–3, is operable in combination with a floating vessel means 1 floating on a body of water 2. Vessel 1 may comprise, for example, a conventional off-shore tug boat.

An anchor pendant line hoisting winch 3, shown in FIG. *7f*, is carried by the floating vessel 2.

An anchor buoy means, comprising a generally cylindrical anchor buoy "can" 4, to be retrieved and thereafter launched during anchor relocating operations, as above described, is depicted in FIG. 1 adjacent the stern 11 of vessel 1. A pendant line 5 is supported by can 4 and passes slideably therethrough as shown in FIG. 1. Pendant line 5 terminates at its upper end in a retrieving eye 51 which abuttingly engages the top 41 of can 4.

b. Major Components of Anchor Buoy Catching, Elevating, and Securing Mechanisms The apparatus or mechanism 6 which characterizes this invention comprises anchor buoy retrieving, securing, and launching means, as shown in FIGS. 1–6.

In brief, and as will be apparent from FIGS. 1, 2, 3, and *7a–7f*, mechanism 6 includes a buoy catching, fork-like, anchor buoy catching means 7, the base or body 71 of which is slideably mounted in a frame 99 of an anchor buoy securing means with a fork 73 projecting outwardly therefrom. This frame 99, in turn, is slideably supported in a pivot mount 91 which is pivotally mounted on the stern 11 of vessel 1. Cable sections 82 and 83, connected at points 76 and 99*e*, respectively, to body 71 and frame 99 cooperate with a sheave 84 and sheave pulling cable 86 to provide an anchor buoy elevating means 8.

With body 71 disposed at the lower end of an upright frame 99, as shown in FIG. 1, a pull exerted on cable 86 will first relatively rapidly raise body 71 within frame 99 until fork 73 engages the cradles the underside of the anchor buoy 4, as shown in FIG. *7a*. A continued pull will cause contined upward movement of body 71 within frame 99, along with some upward sliding and pivotal movement of frame 99 through and about pivot 91, as shown in FIG. *7b*. Still further continued pulling on cable 86 will cause further sliding and pivotal movement of frame 99 relative to pivot mount 91, as shown in FIG. *7c*, until the frame 99 and anchor buoy catching unit 7 and anchor buoy 4 pivot and elevate from an aft location to an on-deck location depicted in FIG. *7d*.

During the pivotal movement of frame 99 relative to pivot 91, a movement impedance mechanism 18 is operable to dampen and/or impede wave action induced forces acting on catching unit 7 and buoy 4. This pivotal movement impeding mechanism will also tend to insure that body 71 will complete its sliding movement in frame 99 and frame 99 will substantially complete its sliding movement through pivot 91 before the pivotal movement of frame 99 about pivot 91 is completed.

As pulling on cable 86 still further continues, the catching unit 7 and anchor buoy move longitudinally of vessel 1, out of frame 99, and away from stern 11, and into a trackway 14, as shown in FIG. *7e*. This movement is permitted because a locking mechanism 16, normally limiting upper sliding movement of body 71 through frame 99, is released by operation of a release mechanism 17 actuated by an engagement of frame 99 with stern deck 13. Mechanisms 16 and 17 are shown in FIGS. 11–14.

Under the influence of pulling cable 86, longitudinal movement of unit 7 and buoy 4 continues until unit 7 and buoy 4 arrive at an immobilized position 12 on deck 13. At this position 10, shown in FIG. *7f*, anchor buoy 4 is clamped between fork 73 and a deck mounted abutment or clamp 15, engaging buoy 4 at aft and fore locations, respectively.

At this point, the pendant line eye 15 may be connected with a cable on winch 3 and the pendant line 5 "hauled in" so as to raise and retrieve the anchor connected to its lower end. The tug 1 may then move the raised anchor to its new location. At the new location, pendant line 5 may be payed out from winch 3, disconnected therefrom, and eye 51 restored to abutting cooperation with the end 41 of buoy 4. The tug 4 may now move forward so as to cause the eye 51 of pendant line 5 to exert a rearward pulling force on buoy 4 and catching unit 7. This force will automatically cause units 7 and 9 to undergo, in general, the reverse sequence *7f* through *7a*, with gravity then restoring units 7 and 9 to the FIG. 1 position so that buoy 4 may float free of the mechanism 6 and catching unit 7. During this reverse sequence the elevating means may be "slacked" or maintained under yieldable tension so as to restrain and control the buoy launching operation.

With the buoy retrieving and launching sequence having been summarized, so as to provide an initial "overview" of the invention, a more detailed discussion of apparatus elements is in order.

As noted, anchor buoy catcing means 7 may comprise a fork-like unit shown in FIGS. 1, 2, and 6. Catching unit 7 is operable to cradle an underportion of the anchor buoy 4, as shown in FIG. *7a* while the anchor buoy 4 is floating on the water body 2 generally adjacent the stern 11 of the floating vessel 1.

The anchor bouy elevating means 8 may comprise a sheave and cable hoisting assembly shown in FIGS. 1 and 2. Elevating means 8 is operable to elevate the anchor buoy catching means 7, with the anchor buoy 4 cradled thereon, as shown in FIGS. *7a–7c*, so as to substantially elevate the anchor buoy 4 above the influence of wave action.

The anchor buoy securing means 9 may comprise a frame-like unit as shown in FIGS. 1, 2, and 6. Securing means 9 is operable to pivot the elevated anchor buoy catching means 7 about the stern portion 11 of the floating vessel 1, as shown in FIG. *7c*, and bring the anchor buoy catching means 7, with the anchor buoy 4 engaged therewith, toward a substantially immobilized position 12 (shown in phantom line in FIG. 1). This safe handling and stabilized buoy position 12, as depicted in FIGS. 1 and *7f*, is located on a stern deck portion 13 of the floating vessel 1 above the body of water 2 and located generally forward of the stern portion 11 of the floating vessel 1.

As above noted, the entire sequence of the anchor buoy retrieving and securing operation is depicted schematically and in sequence in FIGS. *7a* through *7f*.

The pendant line 5 is operable, with the anchor buoy catching means 7 and the anchor buoy 4 disposed in the substantially immobilized position 12 shown in FIG. *7f*, to be manually engaged, as shown in FIG. *7f*, with the pendant line hoisting winch 3 carried by the floating vessel 1. This engagement is effected by manually connecting pendant line eye 51 with a cable on the winch 3. The pendant line hoisting means 3 then is operable to effect hoisting, i.e. reeling in, of the pendant line 5 and consequent raising of the anchor attached to the lower end of the line 5.

The pendant line hoisting means 3 is operable to effect the hoisting of the pendant line 5, as above noted, and is subsequently operable to permit paying out of the pendant line 5. This paying out of the pendant line 5 is operable as the tug 1 moves away from the anchor connected with the line 5 to cause the eye 51 of the pendant line 5 to engage buoy end 41 and exert a pulling force on the anchor buoy 4 directed generally rearwardly of the floating vessel 1. After eye 51 becomes accessible during the unreeling of line 5 from winch 3, it may be disconnected from the cable of winch 3. The pulling force exerted by eye 51 on buoy end 41 is operable to be transmitted through anchor buoy 4 to the anchor buoy catching means 7 and cause the anchor buoy catching means 7, with the anchor buoy 4 engaged therewith, to move generally through the sequence of positions *7f* through *7c*, i.e. move away from the substantially immobilized position 12 and pivot about the stern portion 11 of the floating vessel 1 so as to be disposed generally outboard of said stern portion, the anchor buoy catching means 7 to be lowered toward said water body, as depicted generally in the sequence *7c* through *7a*, and deposit the anchor buoy 4 therein, and the anchor buoy 4 to float free of anchor buoy catching means 7 after this latter means has been fully lowered as depicted in FIG. 1.

As will here be appreciated, the buoy launching sequence, above described, is in general the reverse of the buoy retrieving sequence depicted, in order, by the views *7a–7f* and 1.

Having summarized basic structural and operating aspects of the invention, it is believed appropriate to now consider certain structural aspects of the mechansim 6.

c. Details of Preferred Form of Buoy Catching, Elevating and Securing Mechanisms As shown in FIG. 7, the anchor buoy catching means 7 comprises a generally L-shaped or fork shaped assembly. This assembly includes a body means 71 which is operable to be slideably carried by the anchor buoy securing means 9 by way of mounting rollers 72. Catching mechanism 7 further includes an anchor buoy engaging and supporting fork means 73 including hook-like fork legs 74 and 75 carried by the body 71.

The anchor buoy securing means 9 includes pivot means 91 carried by the stern portion 11 of the floating vessel 1.

Pivot means 91, as shown in FIGS. 1–4, 9 and 10, includes framing 92 and 93 mounted on stern 11 and supporting a pivot shaft assembly 94. A pair of pivot shoes 95 and 96 are journaled on shaft 94. Shoes 95 and 96 include slots 97 and 98, respectively, which are operable to slideably receive mounting edge flanges 99*a* and 99*b* of a frame 99, depicted in FIG. 5. The slideable mounting of frame flange 99*a* in slot 97 of shoe 95 is depicted in FIGS. 9 and 10. FIG. 9 shows these components in the upright condition of frame 99, as shown in FIG. 1, while FIG. 10 shows these components in the FIGS. 3 and *7d* condition.

Frame 99 is thus pivotable and slideably supported by the pivot means 91, as shown in FIGS. 2 and 3, for pivotable movement about the stern 11 of the floating vessel 1, depicted for example, in FIGS. *7b–7c*, generally upright sliding movement, rearwardly of the stern of the floating vessel means, depicted for example in FIG. *7b*, when the anchor buoy securing means 9 is disposed in a generally upright condition as shown in FIG. 2, and sliding movement generally longitudinally of the stern deck 13 of the floating vessel 1, depiced for example in FIGS. *7c–7d*, when the frame 99 is pivoted about the pivot means 91 to extend generally longitudinally of the deck 13.

The body 71 of the anchor buoy catching means 7 is slideably mounted, by its rollers 72, in side channels 99*c* and 99*d* of the frame 99 of the anchor buoy securing means for generally upright sliding movement along frame 99, shown for example in FIGS. *7a–7b*, when frame 99 is disposed in a generally upright condition as depicted in FIG. 2, and generally longitudinal sliding movement along frame 99 with respect to the floating vessel 1, shown for example in FIGS. *7e–7f*, when the frame 99 is extending generally longitudinally of the deck 13 of the floating vessel 1 as depicted in FIG. 3.

The anchor buoy elevating means 8, as shown in FIGS. 1, 2, 5, 6, and *7a*, includes a looped cable 81 connected to each of the body 71 and frame 99.

Cable 81 includes a first cable portion 82 connected with the body 71 by a cable connection 76. A second cable portion 83 is connected with the frame 99 by a cable connection 99*e*.

A sheave 84, included in mechanism 8, is disposed forwardly of the stern portion 11 of the floating vessel 1. A cable loop 85 is reeved through the sheave 84 and interconnects the first and second cable portions 82 and 83.

A pulling cable 86, operated by a winch 87 as shown in FIG. 1, is connected with the sheave 84 and is operable to exert a pulling force on this sheave, away from vessel stern 11.

This force is transmitted through the sheave 84 to each of the first and second cable portions 82 and 83 with the pulling force acting on the first cable portion 82 being operable to sequentially induce, as shown for example in FIGS. *7a–7f*, the above noted generally upright and generally longitudinal sliding movements of the body 71 relative to the frame 99, and with the pulling force acting on the second cable portion 83 being operable to sequentially induce, as shown for example in FIGS. *7a–7d*, the above noted generally upright and generally longitudinal sliding movements of the frame 99 and induce the above noted pivotable movement of the frame 99.

The pulling force acting through the sheave 84 on the body 71 is operable to cause the above noted, generally upright sliding movement of the body 71 to occur at about twice the rate of movement of the pulling means 86 and to be initiated prior to the generally upright sliding movement of the frame 99. This occurs (1) because the frame 99 is generally lighter in weight than catcher 7 and floating buoy 4 and will thus tend to not slide upwardly through pivot 91 until the body 71 reaches its uppermost limit of sliding movement relative to the frame 99 and (2) because of the 2/1 movement ratio induced by the sheave 84 and cable lines 82 and 83 while body 71 slides relative to a nonsliding frame 99. After body 71 engages a releasable lock 16 at the top of frame 99, to be subsequently described, slideable movement of frame 99 through pivot 91 will commence, if it has not commenced earlier as shown in FIG. *7b*.

d. Details of Preferred Track and Buoy Clamping System

If desired, the stabilized position 12 of the buoy catcher 7 could be defined by the initial deck mounted position of frame 99, as depicted in FIG. *7d*.

All this notwithstanding, it is now deemed preferable for stabilized position 12 to be defined at a location closer to the winch mechanisms carried by FIG. 1. This location, remote from stern 11, facilitates storage of the mechanism 6 during normal tug operations so as not to interfere with towing or docking procedures. With the mechanism disclosed at location 12 depicted in FIG. 1, adjacent a battery of hoisting and tow line winches, the mechanism 6 does not obstruct the stern 11 during docking procedures and permits the generally unimpeded passage of a tow line rearwardly of the winch battery, across the vessel stern.

As presently contemplated, station 12 is defined by track-like extensions of each of the I-beam, side members 99*f* and 99*g* of the frame 99.

This track means extension 14, as shown in FIGS. 1 and *7d–f*, is disposed on the stern deck portion of the floating vessel 1 and is located generally forward of the stern portion 11 of this floating vessel or tug 1. Track means 14 may comprise two longitudinally extending, laterally spaced I-beams defining contiguous, axial continuations of frame sides 99*f* and 99*g* when frame 99 is in the deck location depicted in FIG. *7d*. In this connection, it will be appreciated that the final clockwise pivotal movement of frame 99 about 91 (as viewed in FIG. *7c*) with frame 99 having undergone its full extent of sliding movement through slots 97 and 98, will bring the forward ends of frame sides 99*f* and 99*g* into substantially contiguous relation with the ends of the paralleled I-beam rails of track means 14, as shown in FIG. *7d*.

Track means 14 is thus operable to slideably receive the anchor buoy catching means frame 71 and provide the substantially immobilized position 12, remote from stern 11.

The apparatus of this invention may further include anchor buoy engaging, abutments or clamping means 15 extending generally transversely upwardly of the track means 14, as shown in FIGS. 1 and *7e* and *7f*. Clamp means 15 is operable to cooperate with the anchor buoy catching means fork 73 to fixedly engage fore and aft portions of the anchor buoy 4, as shown in FIG. 7, when the anchor buoy catching means 7 is disposed in the substantially immobilized position 12. Clamping means 15 may comprise one or more, padded, post like, buoy engaging units, generally providing mirror-image counterparts of fork legs 74 and 75.

e. Details of Presently Preferred Releasable Interlock Between Buoy Catching and Securing Mechanisms As earlier noted, the buoy catcher body 71 and the securing means body 99 are releasably interconnected by a releasable locking means 16. A lock releasing or disabling means 17, operable in response to engagement of frame 99 with deck 13 is also provided. These components are shown in FIGS. 11–14.

The releasable locking means 16 is operable to releasably interlock the anchor buoy catching means body 71 with the anchor buoy securing means frame 99.

Figure 7D:
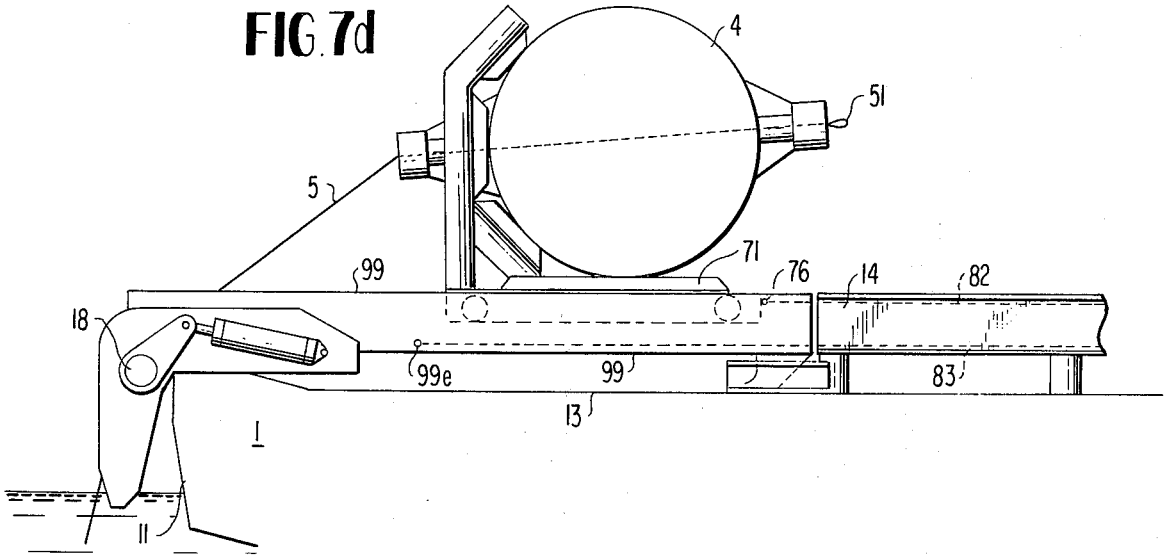
Figure 7E:
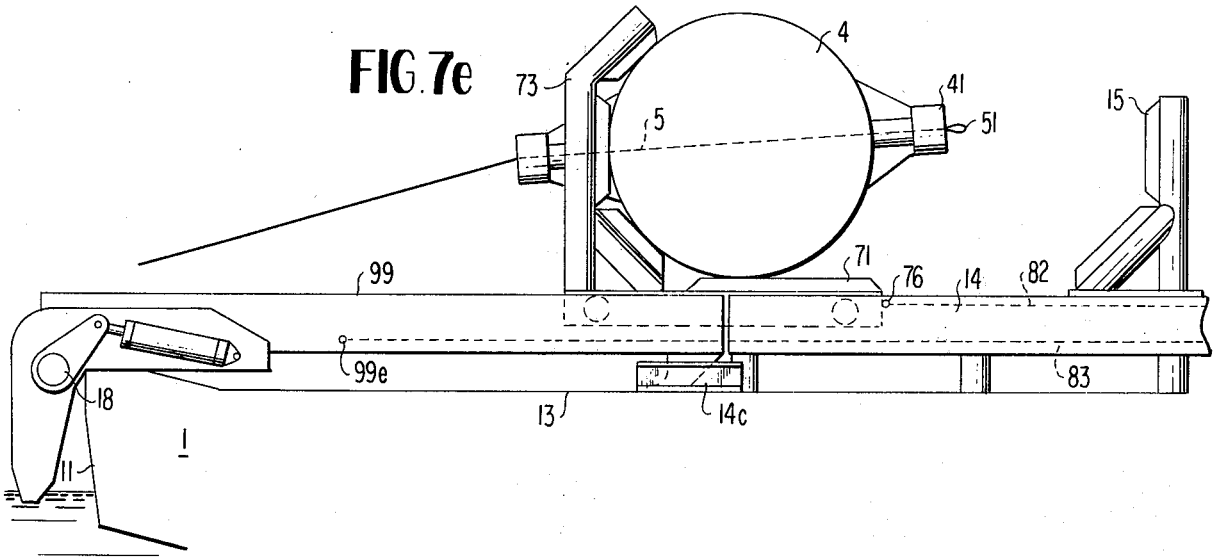
Figure 7F:
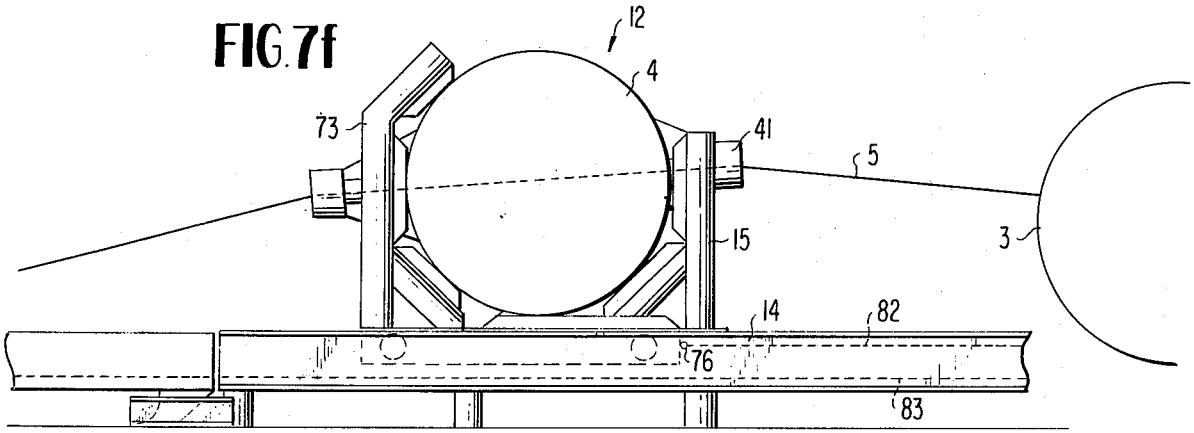

The locking means disabling means 17 is operably responsive to engagement of the anchor buoy securing means frame 99 with the deck portion 13 of the floating vessel 1 to release the releasable locking means 16 and permit the anchor buoy catching means frame 71 to convey the anchor buoy 4, engaged with the anchor buoy catching means 7, at least partially away from the anchor buoy securing means frame 99 and the stern portion 11 of the floating vessel 1, as generally depicted in FIGS. 7*d* and 7*e*.

Locking means 16 may include a locking bar 161, located in each side of frame 99. One such locking bar 161, associated with part frame side 99*g*, is depicted in FIGS. 11–14.

Locking bar 161 is telescopingly mounted in a mounting channel 162 extending transversely of frame side 99*g*, away from outer frame side 163. Bar 161 is biased away from the outer or stern side 163 of frame 99 by tension coil springs 164 and 165. With bar 161 disposed as shown in FIGS. 1, 11, and 12, a bar end or stop 166 is operable to engage the upper end 71*a* of body side 71*b* of catcher body 71, as generally shown in FIG. 12. This arrangement is able to terminate or stop upward sliding movement of body 71 within frame 99.

Bar 161 includes an end portion 167 which provides the lock releasing means 17. The mode of operation of this releasing mechanism is shown in FIGS. 13 and 14.

As depicted in FIGS. 13 and 14, engagement of bar end 167 with deck 13, when frame 99 assumes the FIG. 7*d*, full pivoted position, cuases bar 161 to telescope inwardly of channel 162 against the biasing influence of springs 164–165. This causes stop 166 to move out of the path of body end 71*a* and permit this body end to pass slideably through a bar slot 168, so as to permit the outward slideable movement of catcher 7, out of frame 99, as shown in FIGS. 7*d*–7*e*.

f. Details of Presently Preferred Wave Action Restraining and Pivot Motion Impedance Means and Electromagnetic Buoy Holding Means.

In relation to stabilized manipulation of buoy 4 and releasable holding of the buoy 4 to catcher assembly 7, it is contemplated that a wave action restraining and pivot action impedance means 18 may be provided, along with an electromagnetic, buoy holding means 19.

The wave action restraining means 18 may be operably engaged with the anchor buoy catching means 7 and be operable to dampen movement of this anchor buoy catching means 7 caused by wave-action induced forces.

The electromagnetic holding means 19 may be carried by the anchor buoy catching means 7 and be operable to electromagnetically and releasably secure the anchor buoy means 4 with the anchor buoy catching means 7.

the impedance mechanism 18 is generally depicted in FIGS. 1–4 and 15.

Mechanism 18 includes an hydraulic piston and cylinder assembly 181 operably associated with each of the pivot shoes 95 and 96. One such assembly 181, connected with shoe 95, is shown in FIGS. 1–3 and 15 and is identiical with a corresponding mechanism associated with the other pivot shoe 96.

Assembly 181 includes a cylinder 182 pivotally attached to pivot frame 92 at pivot connection 183 and a piston rod 184 pivotally connected by pivot connection 185 to a lever arm 186. Arm 186 is keyed to a sleeve 95*a* which is connected with shoe 95 and journaled on shaft 94.

Piston rod 184 extends from a piston 187 which is telescoping mounted within the interior of the double ended cylinder 182.

Hydraulic lines 188*a* and 188*b* extend from opposite ends of cylinder 182 and connect with opposite ends of a closed loop, impedance conduit system 189. System 189 includes oppositely acting impedance branches 189*a* and 189*b*. Branch 189*a* includes a flow restrictor 189*c* and check valve 189*d* controlling outflow from one cylinder end 182*a*. Branch 189*b* includes a flow restrictor 189*e* and check valve 189*d* controlling outflow from the other cylinder end 182*b*. This system performs as a double acting hydraulic impedance system, operable to yieldably impede pivoting action of lever arm 186 in either of its opposite directions of pivotal movement. Since lever arm 186 is fixedly attached or keyed to a sleeve 95*a* of pivot shoe 95 (which sleeve 95*a* is freely journaled on pivot shaft 94 of pivot means 91), the impedance action of mechanism 181 acts directly on pivot shoe 95 so as to restrain the influence of wave action acting on a buoy 4 and the catcher 7 and generally impede pivotal movement of the frame 99. (In this connection it will be appreciated that parallel acting and identical impedance units 181 are associated with each of the shoes 95 and 96).

This impedance of wave action induced forces will insure acceptably smooth pivoting action of the frame 99 during buoy retrieving and launching operations. It will also tend to insure that the sliding upward and downward sliding movements of the frame 99 and body 71 will be generally or sufficiently completed before the termination of pivoting movement of the shoes 95 and 96. This will tend to insure that the frame 99 will engage deck 13 generally adjacent or at least reasonably close to the ends of track means 14. This impedance will also tend to insure that the frame 99 and body 71 will be appropriately extended outboard of the stern 11 of vessel 1 during buoy launching so as to effect appropriately, gravitationally induced and hydraulically cushioned restoring movement of the mechanism to the buoy launching condition.

With respect to the electromagnet holding means 19, FIGS. 6 and 8 depict an examplary arrangement now contemplated.

As shown in these figures, two laterally spaced electromagnets 191 and 192 may be carried at the juncture between fork 73 and body 71 so as to engage and secure the right underside of buoy 4, as depicted in FIG. 7*a*. Two other laterally spaced electromagnets 193 and 194 may be carried by body 71 so as to be engageable with the right side of buoy 4, as depicted in FIG. 7*a*.

The operation of electromagnets 191–194 may be appropriately remotely controlled from a convenient location on the vessel 1.

g. Miscellaneous Structural Details

Although major components of the apparatus have been described in detail, both with respect to their structural and operational details, some additional comments are now in order with respect to other structural features.

For example, as shown in FIGS. 2 and 5, frame 99 may include a top roller bar 99*h* journaled at its upper end between frame sides 99*f* and 99*g*. As shown in FIG. 2, roller 99*h* provides a bearing-like surface about which catcher body hoisting cable 82 extends as it passes between the sheave 84 and the mounting point 76 at the upper end of the catcher body 71.

As is best depicted in FIG. 5, frame 99, at its lower end, may include a roller assembly operable to appropriately guide and facilitate passage of the pendant line 5 during the buoy retrieving and launching operations. This roller assembly may include a generally horizontal roller 99*j* journaled at the lower frame end between the frame sides 99*f* and 99*g* and a side roller 99*k* journaled in each of the frame sides 99*f* and 99*g* so as to provide lateral, anti-fouling restraint for the pendant line 5.

At it upper end, frame 99 may include a pair of hook-like appendages 99*l* and 99*m*. As shown for example in FIGS. 8 and 9, these hook-like frame components 99*l* and 99*m* are carried on the inboard side of the frame 99 and have concave openings facing toward the lower end of the frame, when the frame is disposed in the upright condition depicted in FIG. 2.

Hook-like appendages 99*l* and 99*m* operate to engage roller assembly 94 so as to limit downward movement of the frame 99 and support the frame in the retrieving condition depicted, for example, in FIGS. 1 and 2.

This mode of supporting the frame 99 in its upright, outboard condition is facilitated by bearing rollers 94*a* and 94*b*. These rollers may be journaled on shaft 94, as generally depicted in FIGS. 3 and 4, so as to provide appropriate engagement surfaces for the hook-like appendages 99*l* and 99*b* and concurrently operably bearing surfaces for frame side, flange surfaces 99*n* and 99*o*. As will be apparent by reference to FIG. 3, roller bearing 94*a* cooperates with slot 97 of shoe 95 to provide appropriate sliding and rolling support for frame flange 99*n* while roller 94*b* cooperates with slot 98 of pivot shoe 96 to provide an additional sliding and pivotal support for frame flange 99*o*. In this connection it will be appreciated that flanges 99*n* and 99*o*, while undergoing pivotal movement about the shaft assembly 94, rotate about the central axis of the shaft 94 and roller bearing assemblies 94*a* and 94*b* so as to maintain appropriate bearing contact between the frame 99 annd the roller bearings 94*a* and 94*b* during pivoting action of the frame 99.

As earlier noted, a roller 11*a* may also be journaled on shaft 94 between the frame rollers 94*a* and 94*b*, as generally depicted in FIGS. 3 and 4.

As is depicted in FIG. 2, stern roller 11*a* functions as a cable supporting bearing for the cable 83 as it passes from the sheave 84 over the roller 11*a* to the anchor point 99*e* at a location in the lower portion of the frame body.

Appropriate longitudinal or stabilizing support for the frame 99, when it is disposed in the FIG. 2, upright and aft or outboard condition, is provided by components of the pivot frame members 92 and 93, as generally depicted in FIGS. 3 and 4.

As shown in these figures, a generally L-shaped frame 92*a* of component 92 supports a downwardly and somewhat outwardly inclined, frame supporting socket 92*b*. Similarly, component 93 includes an L-shaped frame member 93*a* which also supports a downwardly extending, and somewhat outwardly inclined, frame supporting socket 93*b*. Socket members 92*b* and 93*b* provide abutment-like support means operable to support the underportions 99*n* and 99*o* of the frame 99, when the frame is in the generally upright condition depicted in FIG. 2, thereby limiting clockwise pivotal movement of the frame 99, as depicted in FIG. 2.

As will be apparent by reference to FIG. 4, the several roller bearings 94*a*, 11*a*, and 94*b* are journaled on the shaft 94, with the shaft 94 being mounted in appropriate, apertured shaft mounting means of the frame members 92 and 93. Further, as will be apparent by reference to FIGS. 9 and 10, the frame members 92 and 93 may be interconnected by appropriate tubular supporting components and also be connected by welding to the stern deck 13 so as to extend aft and downwardly over the stern 11. As shown in FIGS. 9 and 10, appropriate tubular support members may be provided between the stern 11 and the frame engaging sockets 92*b* and 93*b*.

In order to limit downward sliding movement of the catcher body 71 through the channel or I-beam side members 99*f* and 99*g* of frame 99, appropriate stops or abutment blocks 99*i* may be fixedly secured in the lower ends of the frame channels 99*c* and 99*d*, within which channels the frame body 71 is slideably mounted.

As will be apparent with reference to FIG. 8, the stop members 99*i* are operable to engage the underside of the catcher body 71 so as to define the lowermost travel limit of the catcher 71 relative to the frame 99 when the mechanism 6 is disposed in the FIG. 2 condition.

By way of further minimizing the likelihood of damage to the buoy 4 or the mechanism 6, appropriate cushioning pads, fabricated of elastomeric, wood or other shock absorbing material, may be appropriately positioned on the outwardly facing surfaces of the catcher mechanism 7 and/or the frame members 99*f* and 99*g*, as well as on other structural components of the mechanism 6.

Thus, for example, as shown in FIG. 6, a series of buoy engageable, cushioning pads 94*a* through 94*b* may be mounted on the starboard side of the catcher 7, with corresponding pads being mounted on the port side of the catcher 7.

As shown in FIGS. 1, 7*d* and 7*e*, frame end receiving and stabilizing shoes 14*c* may be mounted on the deck 13 generally adjacent the aft ends of the track means 14. Each such frame stabilizing shoe 14*c* is longitudinally open ended and open at the top so as to provide a longitudinally extending channel operable to slideably receive an appropriate hook 99*l* or 99*m* of the frame 99. As will be apparent by reference to FIG. 7*d*, the hook-like components 99*l* and 99*m* are configured so as to provide skid-like surfaces on their lower ends when the frame 99 is disposed in the longitudinally extending, deck mounted condition depicted in FIG. 7*d*.

Remaining structural details depicted in the drawings, involving such things as framing, reinforcing, and general mounting arrangements are believed to be self evident from the drawings as to their structural nature and intended functions.

SUMMARY OF GENERAL ADVANTAGES AND UNOBVIOUSNESS OF INVENTION AND ITS INTENDED SCOPE

The mechanism 6 is particularly advantageous in providing an anchor buoy retrieving and launching system which materially improves the safety, efficiency and ease of anchor buoy handling operations.

The forking, buoy retrieving action, as effected by the fork-like catcher 7, facilitates anchor buoy retrieval and launching, while entailing conventional tug manipulations and movements.

The relatively rapid initial lifing action of the catcher 7 stabilizes the anchor buoy retrieving operation and advantageously rapidly elevates the anchor buoy out of the potentially deleterious effect of wave action.

Moreover, the fork-like structure of mechanism 7 enables the pendant line 5, which would normally be under tension during an anchor buoy retrieving operation, to effectively hold the anchor buoy seated in the catcher fork legs, with the pendant line 5 extending downwardly between these legs.

the relatively low center of gravity of the pivot means 91—i.e. substantially at deck level—contributes to stable manipulations of the mechanism 6 as the buoy is being manipulated between outboard and onboard locations.

The disposal of the anchor buoy 4 at a substantially immobilized location, safety removed from the effects of wave action, facilitates to a substantial extent, pendant line and anchor buoy handling operations associated with anchor buoy retrieving and launching sequences.

Moreover, the substantially automatic nature of the buoy launching procedure, effected in response to tension of the pendant line 5 caused by the tug 1 moving away from a reset anchor, permits unusually safe and relatively rapid buoy launching operations.

The impedance mechanism advantageously ameliorates or minimizes the effects of wave action acting on the mechanism 6 and provides a desired control over the sequencing of the relative sliding and pivotal movements of the components 7 and 9.

It is also believed that the deck mounted track and clamp arrangement afford a particuarly stable and reliable anchor buoy immobilizing or securing arrangement.

The releasable locking mechanims uniquely facilitates movement of the anchor buoy catcher 7 into a stabilized position, located relatively remotely from the stern of the tug, with holding means such as the electromagnetic arrangement described stabilizing the anchor buoy 4 in the catcher 7 during the overall anchor buoy handling operation.

In this connection, it will also be appreicated that the components 7 and 9 may be appropriately dimensioned to accommodate any given vessel configuration, as may be the length of the deck track system 14.

It will also be appreciated that with the catcher 7 disposed and stored in the forward stabilized position dpeicted in FIG. *7f*, the mechanism 6 is positioned so as not to adversely interfere with conventional operations entailing the use of a towing line. In the stabilized position depicted in FIG. *7f*, the catcher 7 is sufficiently low and disposed at a sufficiently forward location as to not materially interfere with conventional towing procedures.

As will also be recognized, the mechanism or system 6 can be readily installed on a conventional tug or service boat without requiring a dry docking operation and with minimal modification of existing tug structure.

In addition, the fact that the mechanism 6 can be actuated by existing winch systems of a tug or service boat eliminates the necessity of restoring to special or additional mechanism powering systems.

The overall structural and operating nature of the system is such as to permit a tug operator to readily observe the anchor buoy retrieving and launching operation while remaining at the usual winch control station, which conventionally is located in the same area as the tug engine control station. This enables anchor buoy retrieving and launching operations to be conducted, at least in substantial part, without the necessity of having personnel in the aft deck location, so as to improve the safety and efficiency of anchor buoy handling operations.

In describing the advance in the art presented through this invention, it is recognized that other efforts have been made in the off-shore art to facilitate article retrieving and launching operations. For example Lucht U.S. Pat. No. 3,906,879 (Sept. 23, 1975) and Hubbard et al. U.S. Pat. No. 3,303,945 (Feb. 14, 1967) disclose sliding and pivoting, launching and retrieving devices. However, these devices are not intended for anchor buoy retrieving operations and are not characterized by the distinguishing combination of the basic aspects of the present invention.

It is also recognized that a variety of load handling devices have heretofore been proposed which are operationally characterized by combinations of sliding and pivotal movement of an article or load supporting frame about a corner of a platform. Such concepts are featured, for example, in Greer et al. U.S. Pat. No. 1,252,899 (Jan. 8, 1918); Smith U.S. Pat. No. 2,354,337 (July 25, 1944) and Vonnez et al. U.S. Pat. No. 1,567,478 (Dec. 29, 1925). However, as in the case of the Lucht and Hubbard et al. devices, the Greer et al, Smith, and Vonnez et al. devices are not designed as anchor handling mechanisms and are not characterized by the basic combination of the present invention.

As to the basic combination entailed in the mechanism 6 of the present invention, i.e., the anchor buoy catching means 7, the anchor buoy elevating means 8, and the anchor buoy securing means 9, it will be recognized that substantial variations may be made with respect to structural and manipulative features as described in connection with the preferred embodiment.

Moreover, it will be recognized that features described above may, in certain instances, be eliminated while retaining the basic functional aspects of anchor buoy catching, elevating, and deck-securing.

In summary, those skilled in the off-shore art and familiar with the present disclosure will recognize additions, deletions, substitutions, equivalents, or other modifications which would fall within the scope of the invention as set forth in the appended claims.

What is claimed is:

1. A method for retrieving, securing, and launching an anchor buoy, said method being operable in combination with:

floating vessel means floating on a body of water;

anchor pendant line hoisting means carried by said floating vessel means; and anchor buoy means including pendant line means supported thereon;

said method being characterized by:

providing anchor buoy catching means and causing said anchor buoy catching means to engage said anchor buoy means while said anchor buoy means is floating on said body of water;

providing anchor buoy elevating means and causing said anchor buoy elevating means to elevate said anchor buoy catching means, with said anchor buoy means engaged therewith; and providing anchor buoy securing means and causing said anchor buoy securing means to move said anchor buoy catching means, with said anchor buoy means engaged therewith, toward a substantially immobilized position above said body of water;

with said anchor buoy catching means and said anchor buoy means disposed in said substantially immobilized position, engaging said pendant line means with said pendant line hoisting means carried by said floating vessel means, and causing said pendant line hoisting means to effect hoisting of said pendant line means; and subsequent to said hoisting, causing said pendant line means to exert a pulling force on said anchor buoy means, with said pulling force being operable to cause said anchor buoy means to move away from said substantiially immobilized position generally toward said body of water, and said anchor buoy means to be deposited in said body of water.

2. An apparatus for retrieving, securing, and launching an anchor buoy, said apparatus being operably in combination with;

floating vessel means floating on a body of water;

anchor pendant line hoisting means carried by said floating vessel means; and anchor buoy means including pendant line means supported thereon;

said apparatus being characterized by, and comprising, anchor buoy retrieving, securing, and launching means including:

anchor buoy catching means operable to engage said anchor buoy means while said anchor buoy means is floating on said body of water;

anchor buoy elevating means operable to elevate said anchor buoy catching means, with said anchor buoy means engaged therewith; and anchor buoy securing means operable to move said anchor buoy catching means, with said anchor buoy means engaged therewith, toward a substantially immobilized position above said body of water;

said pendant line means being operable, with said anchor buoy catching means and said anchor buoy means disposed in said substantially immobilized position, to be engaged with said pendant line hoisting means carried by said floating vessel means, with said pendant line hoisting means then being operable to effect hoisting of said pendant line means; and said pendant line hoisting means being operable to effect said hoisting of said pendant line means and operable to permit paying out of said pendant line means subsequent to said hoisting;

said paying out of said pendant line means being operable to permit said pendant line means to exert a pulling force on said anchor buoy means, with said pulling force being operable to cause said anchor buoy means to move away from said substantially immobilized position generally toward said body of water, and said anchor buoy means to be deposited in said body of water.

3. An apparatus as described in claim 2 wherein:

said anchor buoy catching means comprises body means operable to be movably carried by said anchor buoy securing means, and anchor buoy engaging and supporting fork means carried by said body means; and said anchor buoy securing means includes pivot means carried by a stern portion of said floating vessel means, frame means pivotably and slideably supported by said pivot means for pivotable movement about said stern portion of said floating vessel means, generally upright sliding movement rearwardly of said stern portion of said floating vessel means when said anchor buoy securing means is disposed in a generally upright condition, and sliding movement generally longitudinally of a stern deck means of said floating vessel means when said frame means is pivoted about said pivot means to extend generally longitudinally of said deck means;

said body means of said anchor buoy catching means is slideably mounted on said frame means of said anchor buoy securing means for generally upright sliding movement therealong when said frame means is disposed in a generally upright condition, and generally longitudinal sliding movement therealong with respect to said floating vessel means when said frame means is extending generally longitudinally of said deck means of said floating vessel means; and said anchor buoy elevating means includes first cable means connected with said body means, second cable means connected with said frame means, sheave means disposed forwardly of said stern portion of said floating vessel means, cable means reeved through said sheave means and interconnecting said first and second cable means, and pulling means connected with said sheave means and operable to exert a pulling force on said sheave means, with said pulling force being transmitted through said sheave means to each of said first and second cable means.

with said pulling force acting on said first cable means being operable to sequentially induce said generally upright and generally longitudinal sliding movements of said body means relative to said frame means, and with said pulling force acting on said second cable means being operable to sequentially induce said generally upright and generally longitudinal sliding movements of said frame means and induce said pivotable movement of said frame means, and said pulling force acting through said sheave means on said body means to cause said generally upright sliding movement of said body means to occur at at least twice the rate of movement of said pulling means and to be innitiated prior to said generally upright sliding movement of said frame means.

4. An apparatus as described in claim 2 wherein:

said apparatus includes track means disposed on a stern deck portion of said floating vessel means, generally forward of a stern portion of said floating vessel means;

said track means is operable to slideably receive said anchor buoy catching means and provide said substantially immobilized position thereof; and said apparatus includes anchor buoy engaging, clamping means extending generally transversely upwardly of said track means and operable to cooperate with said anchor buoy catching means to fixedly engage fore and aft portions of said anchor buoy means when said anchor buoy catching means is disposed in said substantially immobilized position.

5. An apparatus as described in claim 2 wherein:

said apparatus includes releasable locking means operable to releasably interlock said anchor buoy catching means with said anchor buoy securing means; and said apparatus further includes locking means disabling means operably responsive to engagement of said anchor buoy securing means witth a deck portion of said floating vessel means to release said releasable locking means and permit said anchor buoy catching means to convey said anchor buoy means, engaged with said anchor buoy catching means, at least partially away from said anchor buoy securing means and a stern portion of said floating vessel means.

6. An apparatus as described in claim 2 wherein:

said apparatus includes wave action restraining means operably engaged with said anchor buoy catching means and operable to dampen movement of said anchor buoy catching means caused by wave-action induced forces; and said apparatus includes electromagnetic holding means carried by said anchor buoy catching means and operable to electromagnetically and releasably secure said anchor buoy means with said anchor buoy catching means.

7. An apparatus as described in claim 2 wherein:

said anchor buoy catching means comprises body means operable to be movably carried by said anchor buoy securing means, and anchor buoy engaging and supporting fork means carried by said body means; and said anchor buoy securing means includes pivot means carried by a stern portion of said floating vessel means, frame means pivotably and slideably supported by said pivot means for pivotably movement about said stern portion of said floating vessel means, generally upright sliding movement rearwardly of said stern portion of said floating vessel means when said anchor buoy securing means is disposed in a generally upright condition, and sliding movement generally longitudinally of a stern deck means of said floating vessel means when said frame means is pivoted about said pivot means to extend generally longitudinally of said deck means;

said body means of said anchor buoy catching means is slideably mounted on said frame means of said anchor buoy securing means for generally upright sliding movement therealong when said frame means is disposed in a generally upright condition, and generally longitudinal sliding movement therealong with respect to said floating vessel means when said frame means is extending generally longitudinally of said deck means of said floating vessel means; and said anchor buoy elevating means includes first cable means connected with said body means, second cable means connected with said frame means, sheave means disposed forwardly of said stern portion of said floating vessel means, cable means reeved through said sheave means and interconnecting said first and second cable means, and pulling means connected with said sheave means and operably to exert a pulling force on said sheave means, with said pulling force being transmmitted through said sheave means to each of said first and second cable means, with said pulling force acting on said first cable means being operable to sequentailly induce said generally upright and generally longitudinal sliding movements of said body means relative to said frame means, and with said pulling force acting on said second cable means being operable to sequentially induce said generally upright and generally longitudinal sliding movements of said frame means and induce said pivotable movement of said frame means, and said pulling force acting through said sheave means on said body means to cause said generally upright sliding movement of said body means to occur at at least twice the rate of movement of said pulling means and to be initiated prior to said generally upright sliding movement of said frame means;

said apparatus includes track means disposed on said stern deck means of said floating vessel means, generally forward of a stern portion of said floating vessel means;

said track means is operable to slideably receive said anchor buoy catching means and provide said substantially immobilized position thereof;

said apparatus includes anchor buoy engaging, clamping means extending generally transversely upwardly of said track means and operable to cooperate with said anchor buoy catching means to fixedly engage fore and aft portions of said anchor buoy means when said anchor buoy catching means is disposed in said substantially immobilized position;

said apparatus includes releasable locking means operable to releasably interlock said anchor buoy catching means with said anchor buoy securing means;

said apparatus includes locking means disabling means operably responsive to engagement of said anchor buoy securing means with said stern deck means of said floating vessel means to release said releasable locking means and permit said anchor buoy catching means to convey said anchor buoy means, engaged with said anchor buoy catching means, at least partially away from said anchor buoy securing means and said stern of said floating vessel means;

said apparatus includes wave action restraining means operably engaged with said anchor buoy catching means and operably to dampen movement of said anchor buoy catching means caused by wave-action induced forces; and said apparatus includes holding means carried by said anchor buoy catching means and operable to releasably secure said anchor buoy means with said anchor buoy catching means.

8. An apparatus for retrieving, securing, and launching an anchor buoy, said apparatus being operably in combination with:

floating vessel means floating on a body of water;

anchor pendant line hoisting means carried by said floating vessel means; and anchor buoy means including pendant line means slideably supported thereon;

said apparatus being characterized by, and comprising, anchor buoy retrieving, securing, and launching means including:

anchor buoy catching means operable to cradle an underportion of said anchor buoy means while said anchor buoy means is floating on said body of water generally adjacent said floating vessel means;

anchor buoy elevating means operable to elevate said anchor buoy catching means, with said anchor buoy means cradled thereon so as to substantially elevate said anchor buoy means above the influence of wave action; and anchor buoy securing means operable to pivot said elevated anchor buoy catching means about a stern portion of said floating vessel means and bring said anchor buoy catching means, with said anchor bouy means engaged therewith, toward a substantailly immobilized position on a deck portion of said floating vessel means above said body of water and located generally forward of said stern portion of said floating vessel means;

said pendant line means being operable, with said anchor bouy catching means and said anchor bouy means disposed in said substantially immobilized position, to be engaged with said pendant line hoisting means carried by said floating vessel means, with said pendant line hoisting means then being operable to effect hoisting of said pendant line means; and said pendant line hoisting means being operable to effect said hoisting of said pendant line means and operable to permit paying out of said pendant line means subsequent to said hoisting;

said paying out of said pendant line means being operable to permit said pendant line means to exert a pulling force on said anchor bouy means directed generally rearwardly of said floating vessel means, with said pulling force being operable to be transmitted through said anchor bouy means to said anchor bouy catching means and cause said anchor bouy catching means with said anchor bouy means engaged therewith to move away from said substantially immobilized position and pivot about said stern portion of said floating vessel means so as to be disposed generally outboard of said stern portion, said anchor bouy catching means to be lowered toward said water body and deposit said anchor bouy means therein, and said anchor bouy means to float free of said anchor bouy catching means.

9. An apparatus for retrieving, securing, and launching an anchor buoy, said apparatus comprising:

floating vessel means floating on a body of water;

anchor pendant line hoistting means carried by said floating vessel means;

anchor buoy means including pendant line means supported thereon;

anchor buoy catching means operable to engage said anchor buoy means while said anchor buoy means is floating on said body of water;

anchor buoy elevating means operable to elevate said anchor buoy catching means, with said anchor buoy means engaged therewith; and anchor buoy securing means operable to move said anchor buoy catching means, with said anchor buoy means engaged therewith, toward a substantially immobilized position above said body of water and located generally forward of said stern portion of said floating vessel means;

said pendant line means being operable, with said anchor buoy catching means and said anchor buoy means disposed in said substantially immobilized position, to be engaged with said pendant line hoisting means carried by said floating vessel means, wiith said pendant line hoisting means then being operable to effect hoisting of said pendant line means; and said pendant line hoisting means being operable to effect said hoisting of said pendant line means and operable to permit paying out of said pendant line means subsequent to said hoisting;

said paying out of said pendant line means being operable to permit said pendant line means to exert a pulling force on said anchor buoy means directed generally rearwardly of said floating vessel means, with said pulling force being operable to cause said anchor buoy means to move away from said substantially immobilized position so as to be disposed generally outboard of said stern portion, and;

said anchor buoy means to be deposited in said body of water.

10. An apparatus for retrieving, securing, and launching an anchor buoy, said apparatus comprising:

floating vessel means floating on a body of water;

anchor pendant line hoisting means carried by said floating vessel means;

anchor buoy means including pendant line means slideably supported thereon;

anchor buoy catching means operable to cradle an underportion of said anchor buoy means while said anchor buoy means is floating on said body of water generally adjacent said floating vessel means;

anchor buoy elevating means operable to elevate said anchor buoy catching means, with said anchor buoy means cradled thereon so as to substantially elevate said anchor buoy means above the influence of wave action; and anchor buoy securing means operable to pivot said elevated anchor buoy catching means about a stern portion of said floating vessel means and bring said anchor buoy catching means; with said anchor buoy means engaged therewith, toward a substantially immobilized position on a deck portion of said floating vessel means above said body of water and located generally forward of said stern portion of said floating vessel means;

said pendant line means being operable, with said anchor buoy catching means and said anchor buoy means disposed in said substantially immobilized position, to be engaged with said pendant line hoisting means carried by said floating vessel means, with said pendant line hoisting means then being operable to effect hoisting of said pendant line means; and said pendant line hoisting means being operable to effect said hoisting of said pendant line means and operable to permit paying out of said pendant line means subsequent to said hoisting;

said paying out of said pendant line means being opeerable to permit said pendant line means to exert a pulling force on said anchor buoy means directed generally reqrwardly of said floating vessel means, with said pulling force being operable to be transmitted through said anchor buoy means to said anchor buoy catching means and cause said anchor buoy catching means with said anchor buoy means engaged therewith to move away from said substantially immobilized position and pivot about said stern portion of said floating vessel means so as to be disposed generally outboard of said stern portion, said anchor buoy catching means to be lowered toward said water body and deposit said anchor buoy means therein, and said anchor buoyy means to float free of said anchor buoy catching means.

* * * * *